United States Patent [19]

Glover et al.

[11] Patent Number: 4,538,725

[45] Date of Patent: Sep. 3, 1985

[54] COMPACT HAVING A REMOVABLE GODET

[75] Inventors: Loren J. Glover, Roy, Utah; Milton O. Flower, Van Nuys; David J. Pinassi, Beverly Hills, both of Calif.

[73] Assignee: Max Factor & Co., Hollywood, Calif.

[21] Appl. No.: 628,786

[22] Filed: Jul. 9, 1984

[51] Int. Cl.[3] ..... A45C 11/00; B65D 25/02; B65D 77/26

[52] U.S. Cl. ..... 206/37; 132/79 C; 220/306; 220/307; 220/411; 206/1.7

[58] Field of Search ..... 206/37, 445, 0.82, 0.83, 206/1.7, 1.8; 220/307, 306, 411, DIG. 26; 132/79 C, 79 R

[56] References Cited

U.S. PATENT DOCUMENTS

| | | | |
|---|---|---|---|
| 1,643,944 | 10/1927 | Cook . | |
| 1,647,917 | 11/1927 | Kendall . | |
| 1,840,616 | 1/1932 | Burke | 220/411 |
| 2,033,295 | 3/1936 | Parkin . | |
| 2,370,928 | 3/1945 | Baldanza . | |
| 2,866,467 | 12/1958 | Bradford . | |
| 2,880,262 | 3/1959 | Bell et al. | 220/307 |
| 2,990,054 | 6/1961 | Gellman | 220/411 |
| 3,214,012 | 10/1965 | Mack . | |
| 3,297,974 | 1/1967 | Pittman | 200/306 |
| 3,558,007 | 1/1971 | Seghezzi et al. | 206/445 |
| 4,132,306 | 1/1979 | Margolin | 206/37 |

*Primary Examiner*—William T. Dixson, Jr.
*Attorney, Agent, or Firm*—Flehr, Hohbach, Test, Albritton & Herbert

[57] ABSTRACT

The compact, including the removable godet, contained within the plastic base is disclosed herein. The base is integrally formed as a single unit and also includes a tab and the rib is spaced from but in close proximity to one another. The tab is movable between a biased position for engaging and retaining the godet within the receiving area defined by the base and a second forced position, for allowing the godet to be removed therefrom. The rib prevents the tab from moving beyond its second position away from its biased first position, whereby to prevent a user from inadvertently breaking it.

4 Claims, 4 Drawing Figures

COMPACT HAVING A REMOVABLE GODET

The present invention relates generally to compacts and more particularly to one which is specifically designed to contain a removable godet.

Heretofore, compacts including removable makeup have been relatively complicated. One example is shown in U.S. Pat. No. 1,647,917. There, an ejector system including a clip and cooperating ring is utilized to removably retain a compact plate within its housing.

In view of the foregoing, it is an object of the present invention to provide a relatively uncomplicated and economical compact including a removable godet (a piece of makeup).

Another object of the present invention is to provide the last mentioned compact with an uncomplicated and reliable means for releasably retaining the godet in place and, particularly, a releasable retaining means which is difficult for the user to inadvertently damage during use.

As will be seen hereinafter, the compact disclosed herein is comprised of a housing including an integrally formed, one piece, plastic base defining an area to receive and contain the removable godet which, in turn, is configured to removably fit within that area. A plastic tab formed as an integral part of the housing's base is designed to move between a biased first position for engaging and retaining the godet within the receiving area and a second, forced position for allowing the godet to be removed therefrom by the user. In accordance with the present invention, the base also includes means, preferably an integrally formed plastic rib, for preventing the tab from moving beyond its second position in the direction away from its first position, whereby to prevent it from being inadvertently bent to its breaking point by the user.

The compact will be described in more detail hereinafter in conjunction with the drawing, wherein.

Figure 1:
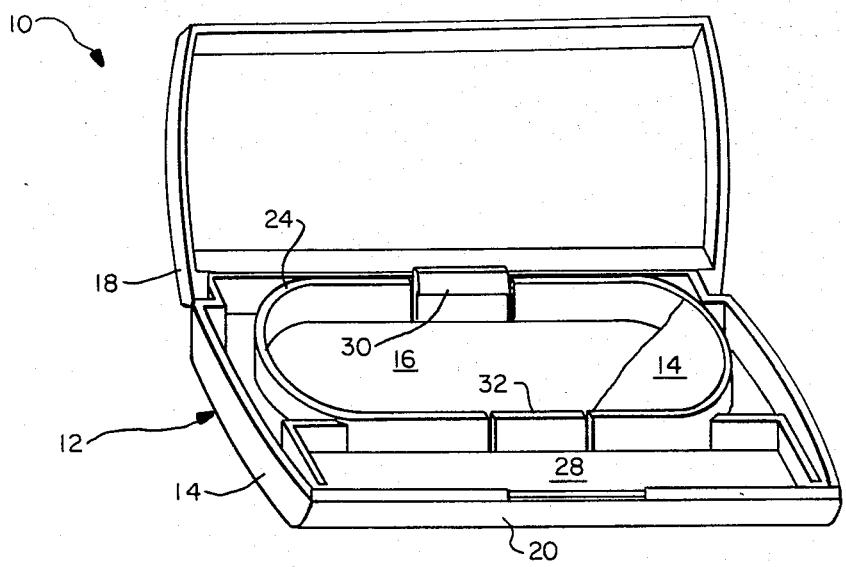
FIG. 1 is a prospective view of the compact, designed in accordance with the present invention.

Turning now to the drawings, wherein like components are designated by like referencing throughout the figures, attention is first directed FIG. 1 which illustrates a compact 10 designed in accordance with the present invention. This compact is shown including a housing 12 containing a removable godet 14. The housing itself includes an integrally formed, one piece, plastic base 14 defining an area 16 configured to receive godet 14 and a lid 18 connected with the base by suitable means such as hinges for movement relative to the base between the opened position shown in FIG. 1 and a closed position (not shown).

Figure 2:
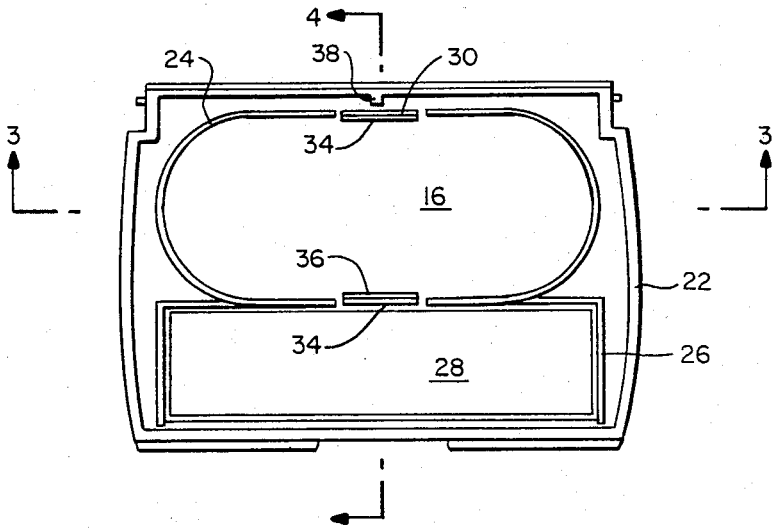
FIG. 2 is a top plan view of the base of the compact illustrated in FIG. 1.
Figure 3:
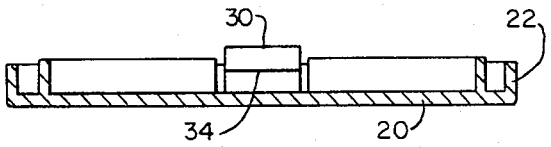
FIGS. 3 and 4 are sectional views of the base shown in FIG. 2, respectively taken generally along the lines of 3—3 and 4—4 in FIG. 2.
Figure 4:
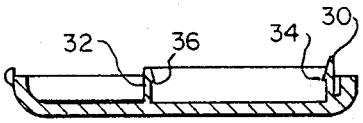

Referring specifically to base 14, attention is directed to FIGS. 2–4, in conjunction with FIG. 1. As seen there, the base includes a lowermost bottom side 20, located below the generally rectangular arrangement of upstanding side walls 22 which define the outermost extent of the base. Located within the confines of side walls 22 on underside 20 are interior upstanding walls 24 and 26 which respectively define godet receiving area 16 and a second area 28 for containing cosmetic utensils.

As best seen in FIG. 2, area 16 is defined not only by the two side walls 24, but also by means of integral tabs 30 and 32, which are located there between and which also extend up from bottom side 20. Both of these tabs are undercut at the same horizontal elevation, as best illustrated in FIG. 4, at 34 and 36. Moreover, both taper rearwardly and upwardly from these undercuts, and both are sufficiently thin to be somewhat flexible. As a result, these tabs allow godet 14 to be readily positioned into area 16 and, once the godet is so positioned, the tabs retain it in that position. More specifically, the godet is sized to just fit within area 16 and, thus, requires that the tabs be forced outwardly (away from area 16) in order to accomplish this. At the same time, the godet is sufficiently thin (vertically) so as to extend below undercuts 34 and 36, thereby allowing the tabs to move back into their normal (biased) positions. Accordingly, in order to remove the godet once it is positioned within area 16, at least one of the tabs 30 or 32 must be pulled outwardly. As will be seen below, tab 30 has been designed for this purpose.

As just stated, tab 30 is specifically designed to serve as a release mechanism for godet 14. As a result, this tab is sufficiently thin below its undercut to be movable between a biased first position, illustrated best in FIG. 4, for engaging and retaining the godet within the receiving area 16 and a second forced position away from area 16 for allowing the godet to be removed therefrom. The tab is also preferably slightly longer vertically than tab 32, in order to allow the user to pull it back more readily.

In accordance with the present invention, base 14 is provided with sn integral rib 38 located behind and in close proximity to but spaced from tab 30, as best illustrated in FIG. 2. This rib is spaced sufficiently far from tab 30 to allow the latter to move to its second, godet releasing position, but is sufficiently close to the tab to prevent the latter from moving beyond its second position. In this way, the rib prevents a user from invertently bending tab 30 to it breaking point.

What is claimed:

1. A compact, comprising: a housing including an integrally formed, one piece plastic base defining an area to receive and contain a removable godet; a godet configured to removably fit within said area; a plastic tab formed as an integral part of said base so as to be movable between a biased first position for engaging and retaining said godet within said receiving area and a second forced position for allowing the removal of said godet within said receiving area; and means for preventing said tab from moving beyond said second position in the direction away from said first position, whereby to prevent said tab from inadvertantly being bent to its breaking point.

2. A compact according to claim 1 wherein said preventing means include a plastic rib formed as an integral part of said base.

3. A compact according to claim 2 wherein said housing includes a cover connected with said base.

4. A compact according to claim 3 including a second tab for aiding said first-mentioned tab in retaining said godet within said area.

* * * * *